US011366407B2

(12) United States Patent
Cho et al.

(10) Patent No.: US 11,366,407 B2
(45) Date of Patent: Jun. 21, 2022

(54) STRUCTURE TO REFILL TONER TO DEVELOPMENT CARTRIDGE MOUNTED IN MAIN BODY

(71) Applicant: HEWLETT-PACKARD DEVELOPMENT COMPANY, L.P., Spring, TX (US)

(72) Inventors: Yong-Kwan Cho, Uiwang-si (KR); Seung Gweon Lee, Suwon-si (KR); Jiwon Moon, Ahnyang-si (KR); Woongyong Choi, Yongin-si (KR); Yongil Moon, Seoul (KR); Yongnam Ahn, Suwon-si (KR); Jinhwa Hong, Seoul (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/051,081

(22) PCT Filed: Mar. 1, 2019

(86) PCT No.: PCT/US2019/020358
§ 371 (c)(1),
(2) Date: Oct. 27, 2020

(87) PCT Pub. No.: WO2020/046420
PCT Pub. Date: Mar. 5, 2020

(65) Prior Publication Data

US 2021/0232061 A1 Jul. 29, 2021

(30) Foreign Application Priority Data

Aug. 30, 2018 (KR) ..... 10-2018-0102521

(51) Int. Cl.
*G03G 15/08* (2006.01)
*G03G 21/18* (2006.01)
(Continued)

(52) U.S. Cl.
CPC ..... *G03G 15/0867* (2013.01); *G03G 15/0865* (2013.01); *G03G 15/0877* (2013.01);
(Continued)

(58) Field of Classification Search
CPC ..... G03G 15/0867; G03G 15/0877; G03G 21/185; G03G 15/6573; G03G 15/0865;
(Continued)

(56) References Cited

U.S. PATENT DOCUMENTS 4,470,689 A * 9/1984 Nomura ..... G03G 15/75 355/71
4,615,364 A * 10/1986 Kawata ..... G03G 15/0886 222/513

(Continued)

FOREIGN PATENT DOCUMENTS

EP 0331324 9/1993
EP 2102715 9/2009

(Continued)

*Primary Examiner* — Walter L Lindsay, Jr.
*Assistant Examiner* — Laura Roth
(74) *Attorney, Agent, or Firm* — Staas & Halsey LLP

(57) ABSTRACT

A printer may include a main body and a development cartridge attachable to and detachable from the main body. The development cartridge may comprise a developing portion in which a photoconductive drum and a developing roller are provided, a waste toner container to receive waste toner removed from the photoconductive drum, a toner container connected to the developing portion and to receive toner, and a toner refilling portion connected to the toner container and to refill toner through the toner refilling portion into the toner container. The printer may include a
(Continued)

communicating portion provided in the main body to be connected to the toner refilling portion to provide an access the toner refilling portion from outside of the main body when the development cartridge is attached to the main body.

13 Claims, 10 Drawing Sheets

(51) Int. Cl.
*G03G 21/16* (2006.01)
*G03G 15/00* (2006.01)

(52) U.S. Cl.
CPC ..... *G03G 21/185* (2013.01); *G03G 15/6552* (2013.01); *G03G 21/1633* (2013.01)

(58) Field of Classification Search
CPC ..... G03G 2215/0636; G03G 21/18; G03G 15/6552; G03G 2215/00421; G03G 15/0874; G03G 2221/169; G03G 21/1633
See application file for complete search history.

(56) References Cited

U.S. PATENT DOCUMENTS 4,660,960 A * 4/1987 Fukunaga ..... G03G 21/105 222/DIG. 1
5,206,692 A 4/1993 Ishida et al.
5,526,099 A * 6/1996 Katakabe ..... G03G 15/0822 399/258
5,710,963 A * 1/1998 Dirx ..... G03G 15/0855 399/258
5,848,516 A * 12/1998 Ban ..... G03G 15/0875 53/423
5,923,922 A * 7/1999 Ishida ..... G03G 15/065 399/98
6,212,338 B1 4/2001 Hagihara et al.
6,339,689 B1 * 1/2002 Sugiura ..... G03G 15/0865 399/358
6,862,420 B1 * 3/2005 Less ..... G03G 15/0884 399/258
2005/0220481 A1 10/2005 Yamaguchi et al.
2007/0230999 A1 10/2007 Shimomura
2012/0177406 A1 * 7/2012 Suzuki ..... G03G 15/0874 399/120
2014/0003836 A1 1/2014 Burchette
2015/0023689 A1 1/2015 Tan et al.
2016/0202661 A1 7/2016 Ushiozu et al.
2018/0136583 A1 5/2018 Park et al.

FOREIGN PATENT DOCUMENTS

JP 05257382 A * 10/1993
JP 06040595 2/1994
JP 08137229 A * 5/1996
JP 11167263 6/1999
JP 2002108082 4/2002
JP 2003084549 A * 3/2003
JP 2005107524 4/2005
JP 2013113958 6/2013
JP 2013171065 9/2013

* cited by examiner

STRUCTURE TO REFILL TONER TO DEVELOPMENT CARTRIDGE MOUNTED IN MAIN BODY

CROSS REFERENCE TO RELATED APPLICATIONS

This application is filed under 35 U.S.C. 0.371 as a National Stage of PCT International Application No. PCT/US2019/020358, filed on Mar. 1, 2019, in the U.S. Patent and Trademark Office, which claims the priority benefit of Korean Patent Application No. 10-2018-0102521, filed on Aug. 30, 2018, in the Korean Intellectual Property Office. The disclosures of PCT International Application No. PCT/US2019/020358 and Korean Patent Application No. 10-2018-0102521 are incorporated by reference herein in their entireties.

BACKGROUND

Printers using an electrophotographic method form a visible toner image on a photoconductor by supplying toner to an electrostatic latent image formed on the photoconductor, transfer the toner image to a print medium directly or through an intermediate transfer medium, and then fix the transferred toner image on the print medium.

A development cartridge receives toner, and forms visible toner image by supplying the toner to an electrostatic latent image formed on a photoconductor. When the development cartridge runs out of toner, the development cartridge may be removed from a main body of a printer and a new development cartridge may be mounted on the main body. A replaceable development cartridge is referred to as a development cartridge.

Development cartridges may be classified into a separate-type development cartridge in which a photoconductive portion including a photoconductive drum and a developing portion including a developing roller are individually replaceable, and an integrated development cartridge in which the photoconductive portion and the developing portion are integrated with each other.

DETAILED DESCRIPTION

Figure 1:
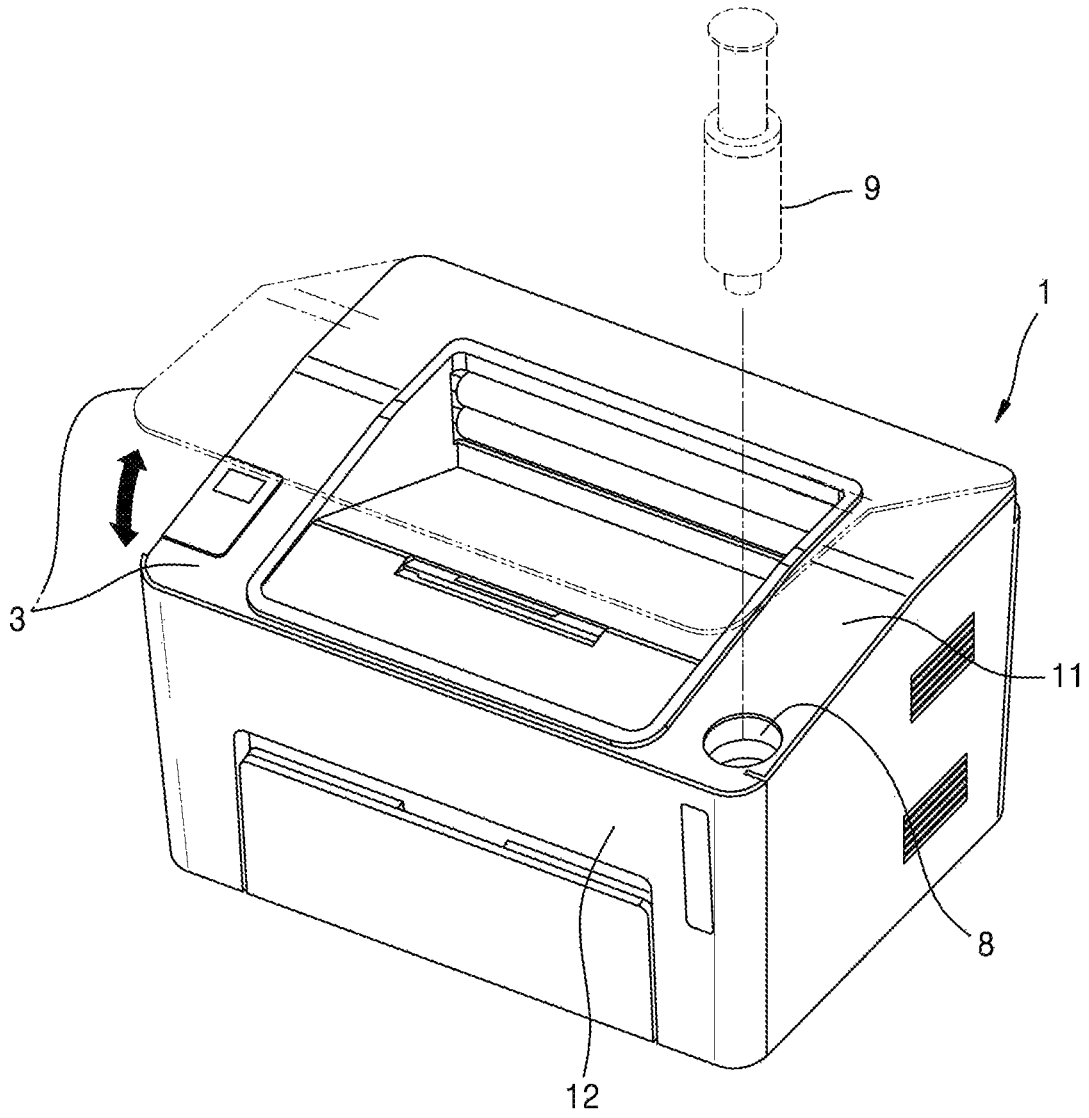
FIG. 1 is a perspective view illustrating an outer appearance of a printer according to an example.
Figure 2:
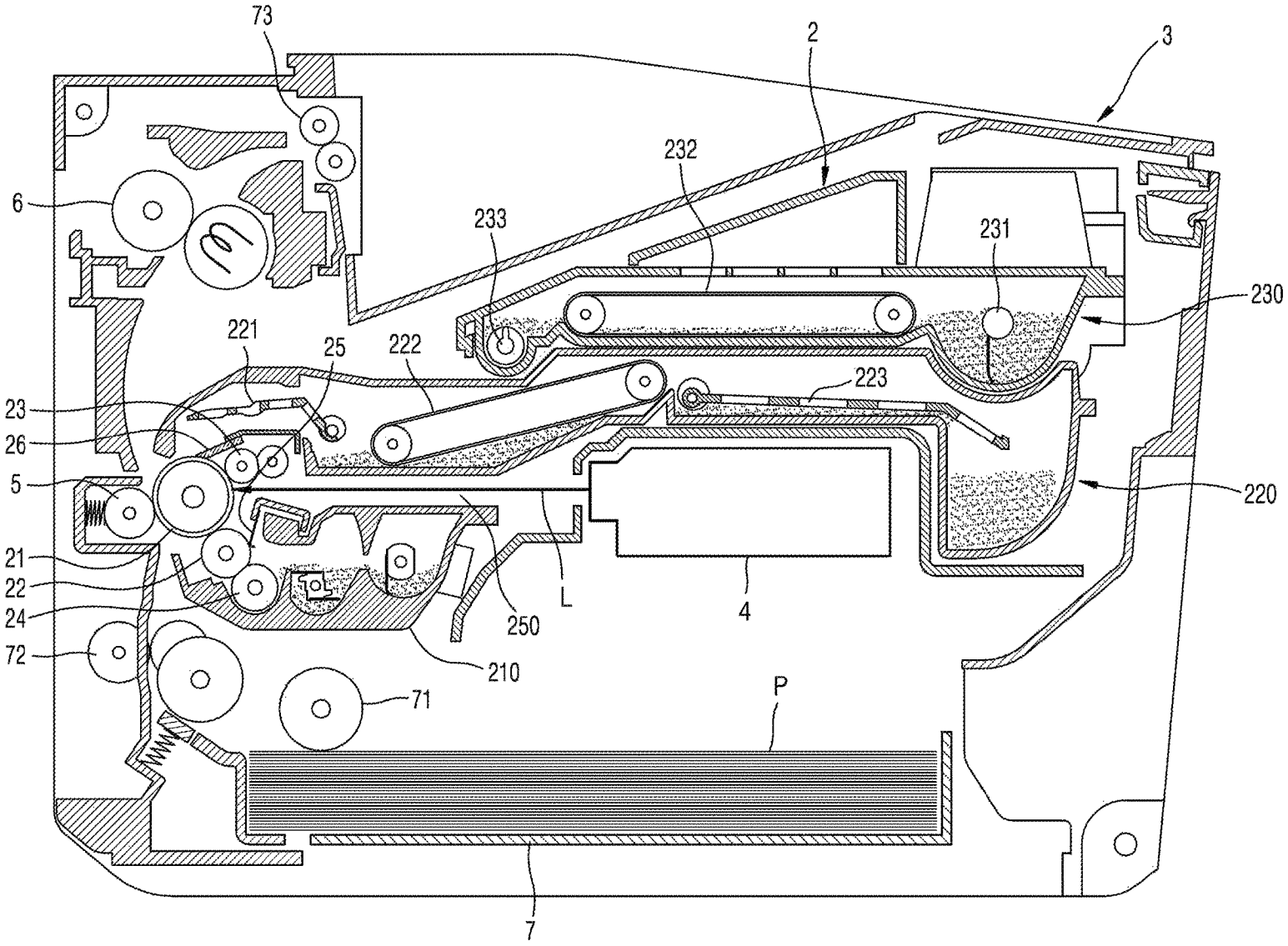
FIG. 2 is a schematic view illustrating a configuration of the printer of FIG. 1, according to an example.

FIG. 1 is a perspective view illustrating an outer appearance of a printer according to an example. FIG. 2 is a schematic view illustrating a configuration of the printer of FIG. 1, according to an example. Referring to FIGS. 1 and 2, the printer may include a main body 1 and a developing device 2 in a cartridge shape attachable to/detachable from the main body 1. Hereinafter, the developing device 2 is referred to as a development cartridge 2. A door 3 may be provided on the main body 1. The door 3 opens/closes a portion of the main body 1. Although the door 3 opens an upper portion of the main body 1 in FIG. 1, a door for opening a side portion of the main body 1 or a front portion of the main body 1 may be used, if necessary. The door 3 may be opened and the development cartridge 2 may be attached to/detached from the main body 1.

The development cartridge 2 may include a photoconductive drum 21 and a developing roller 22. The photoconductive drum 21, as a photoconductor on which an electrostatic latent image is formed, may include a cylindrical metal pipe and a photosensitive layer having photoconductivity and formed on an outer circumferential surface of the cylindrical metal pipe. A charging roller 23 is a charger that charges a surface of the photoconductive drum 21 to have a uniform electric potential. A charging bias voltage is applied to the charging roller 23. A corona charger (not shown), instead of the charging roller 23, may be used. The developing roller 22 supplies toner to the electrostatic latent image formed on the surface of the photoconductive drum 21 and develops the electrostatic latent image.

When a two-component development method using toner and a carrier as a developer is used, the developing roller 22 may include a rotating sleeve and a magnet fixedly located inside the rotating sleeve. The rotating sleeve may be spaced apart from the photoconductive drum 21 by several tens to several hundreds of micrometers. The carrier is attached to an outer circumferential surface of the developing roller 22 due to a magnetic force of the magnet, and the toner is attached to the carrier due to an electrostatic force, and thus a magnetic brush formed of the carrier and the toner is formed on the outer circumferential surface of the developing roller 22. Only the toner is moved to the electrostatic latent image formed on the photoconductive drum 21 due to a developing bias voltage applied to the developing roller 22.

When a one-component development method using toner as a developer is used, the developing roller 22 may contact the photoconductive drum 21, or may be spaced apart from the photoconductive drum 21 by several tens to several hundreds of micrometers. In the present example, a one-component development method in which a development nip is formed when the developing roller 22 and the photoconductive drum 21 contact each other is used. The developing roller 22 may include a conductive metal core (not shown) and an elastic layer (not shown) formed on an outer circumferential surface of the conductive metal core. When a developing bias voltage is applied to the developing roller 22, the toner is moved and attached to the electrostatic latent image formed on the surface of the photoconductive drum 21 through the development nip.

The developing cartridge 2 may further include a supply roller 24 that attaches the toner to the developing roller 22.

A supply bias voltage may be applied to the supply roller 24 so that toner is attached to the developing roller 22. Reference numeral 25 denotes a regulating member for regulating the amount of toner attached to a surface of the developing roller 22. The regulating member 25 may be a regulating blade whose front end contacts the developing roller 22 at a predetermined pressure. Reference numeral 26 denotes a cleaning member for removing residual toner and a foreign material from the surface of the photoconductive drum 21 before a charging operation. The cleaning member 26 may be a cleaning blade whose front end contacts the surface of the photoconductive drum 21. Hereinafter, the foreign material removed from the surface of the photoconductive drum 21 is referred to as waste toner.

An optical scanner 4 scans light modulated according to image information to the surface of the photoconductive drum 21 charged to a uniform electric potential. A laser scanning unit (LSU) of deflecting light emitted from a laser diode in a main scanning direction by using a polygon mirror and scanning the deflected light to the photoconductive drum 21 may be used as the optical scanner 4.

A transfer roller 5 is a transfer unit facing the photoconductive drum 21 and configured to form a transfer nip. A transfer bias voltage for transferring the toner image developed on the surface of the photoconductive drum 21 to a print medium P is applied to the transfer roller 5. A corona transfer unit may be used instead of the transfer roller 5.

The toner image transferred to a surface of the print medium P by the transfer roller 5 is maintained on the surface of the print medium P due to electrostatic attraction. A fuser 6 forms a permanent print image on the print medium P by fixing the toner image onto the print medium P by applying heat and pressure.

An image forming process will now be described briefly. A charging bias voltage is applied to the charging roller 23, and the photoconductive drum 21 is charged to a uniform electric potential. The optical scanner 4 forms an electrostatic latent image on the surface of the photoconductive drum 21 by scanning light modulated in correspondence with image information to the photoconductive drum 21. The supply roller 24 allows toner to be attached to the surface of the developing roller 22. The regulating member 25 forms a toner layer having a uniform thickness on the surface of the developing roller 22. A developing bias voltage is applied to the developing roller 22. As the developing roller 22 rotates, the toner conveyed to a development nip is moved and attached to the electrostatic latent image formed on the surface of the photoconductive drum 21 due to the developing bias voltage, and a visible toner image is formed on the surface of the photoconductive drum 21. The print medium P picked up from a loading tray 7 by a pickup roller 71 is fed by a feed roller 72 to a transfer nip where the transfer roller 5 and the photoconductive drum 21 face each other. When a transfer bias voltage is applied to the transfer roller 5, the toner image is transferred to the print medium P due to electrostatic attraction. The toner image transferred to the print medium P is fixed onto the print medium P due to heat and pressure applied by the fuser 6, thereby completing a printing operation. The print medium P is discharged by a discharge roller 73. A portion of the toner remaining on the surface of the photoconductive drum 21 without being transferred to the print medium P is removed by the cleaning member 26.

Figure 3:
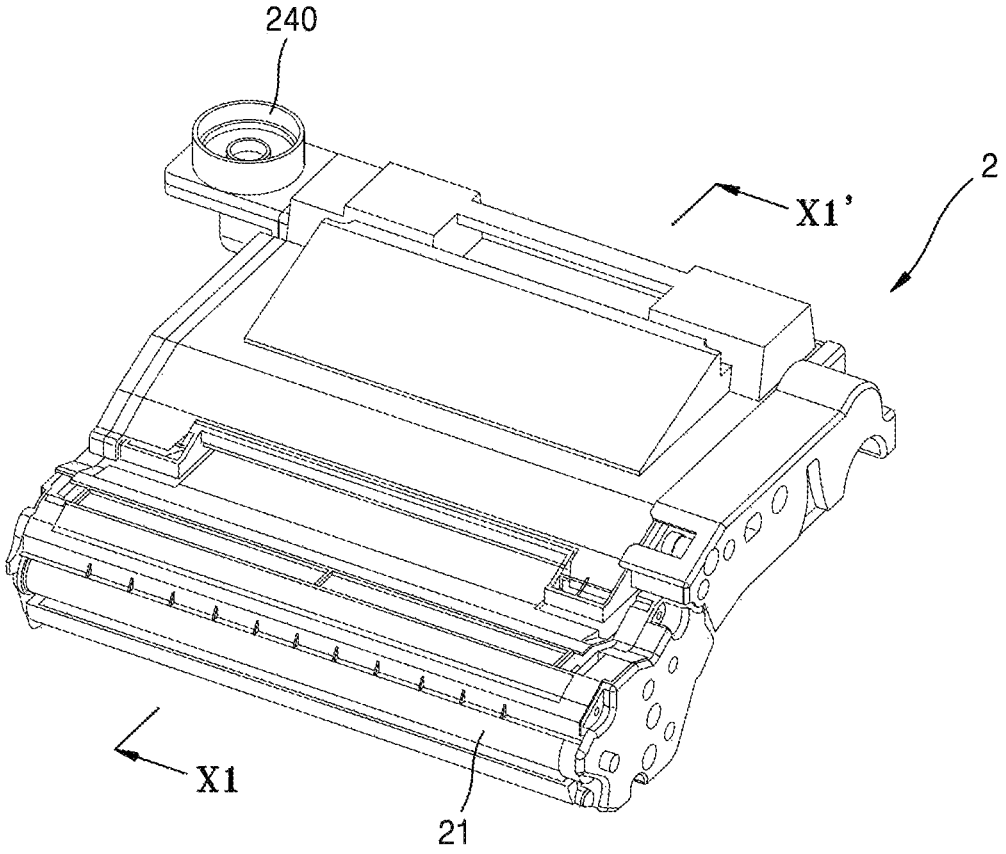
FIG. 3 is a perspective view of a development cartridge used in the printer of FIG. 1, according to an example.
Figure 4:
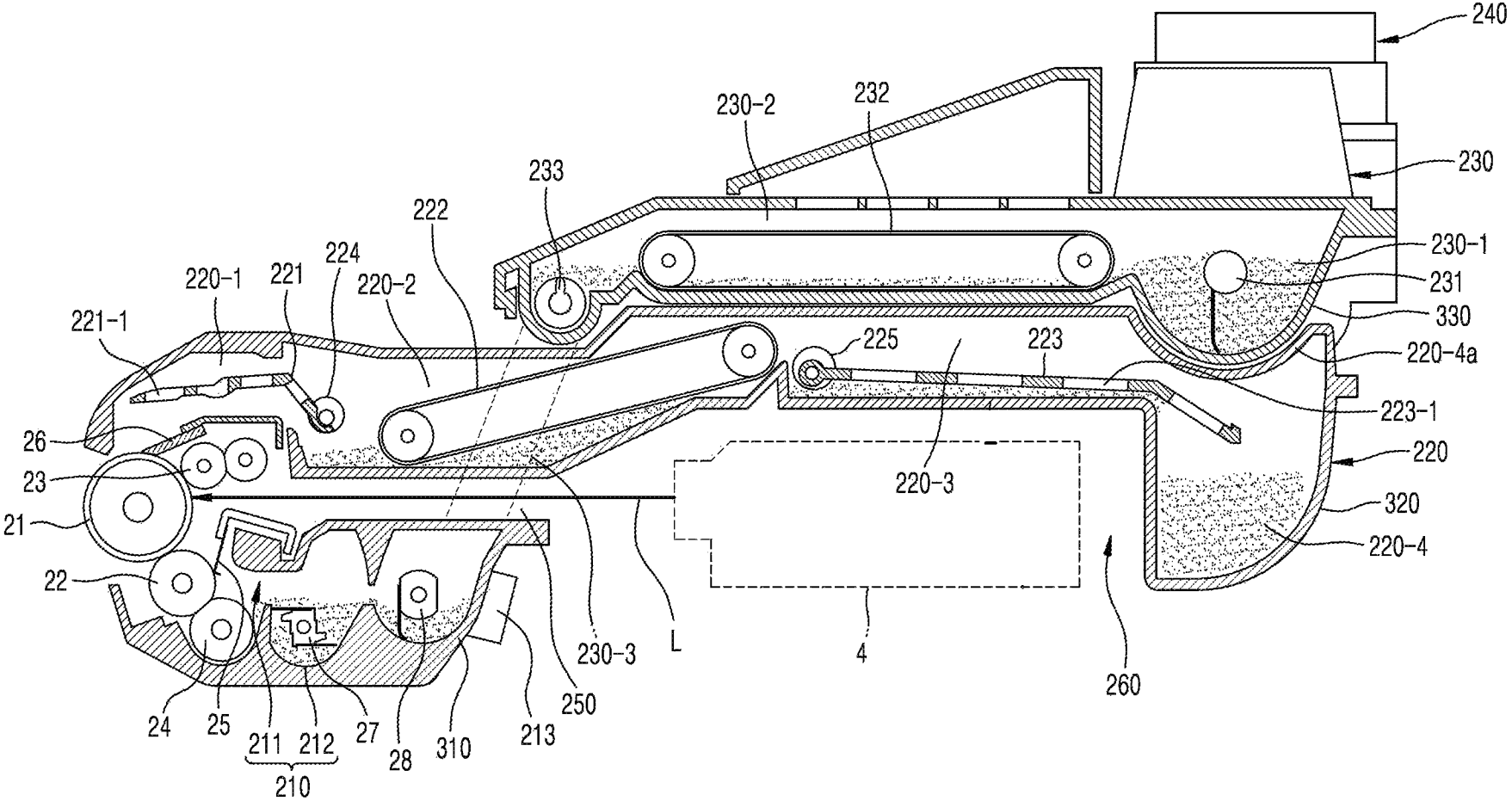
FIG. 4 is a cross-section taken along a line X1-X1' of FIG. 3.
Figure 5:
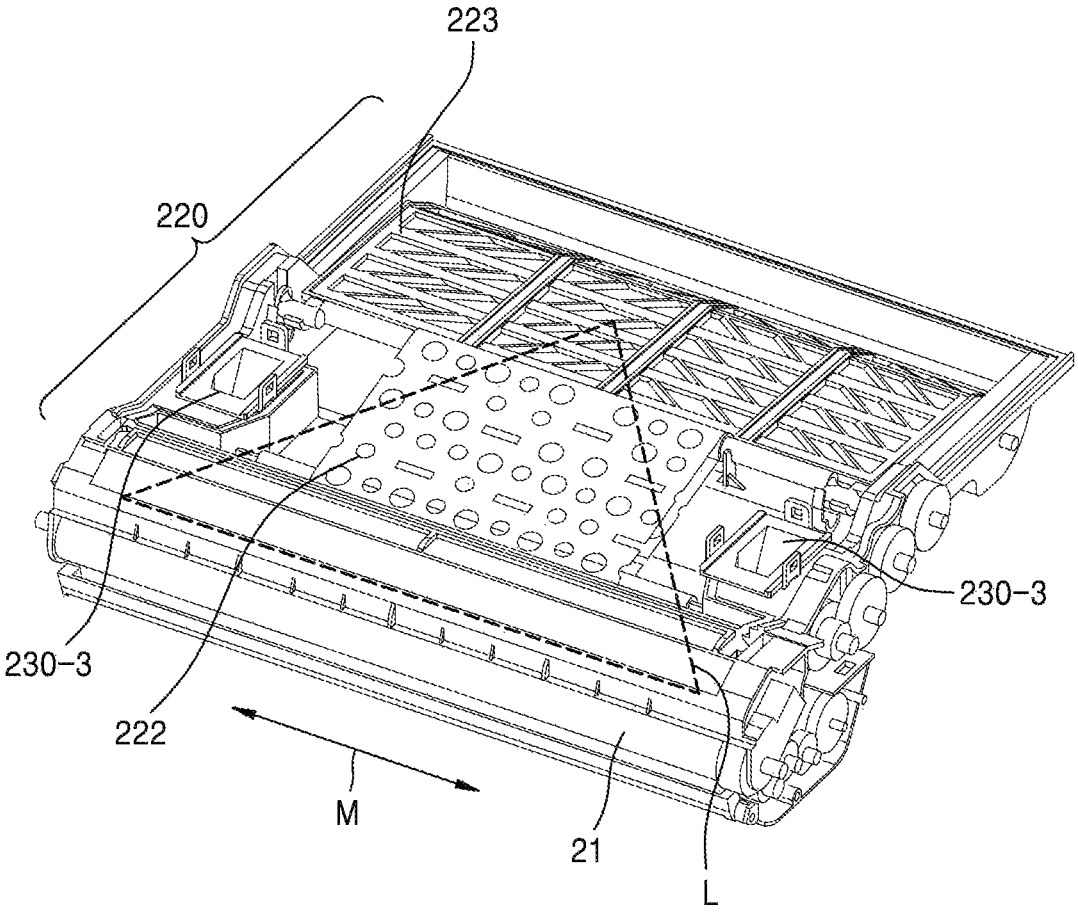
FIG. 5 is a perspective view illustrating an interior of a waste toner container included in the development cartridge of FIG. 3.
Figure 6:
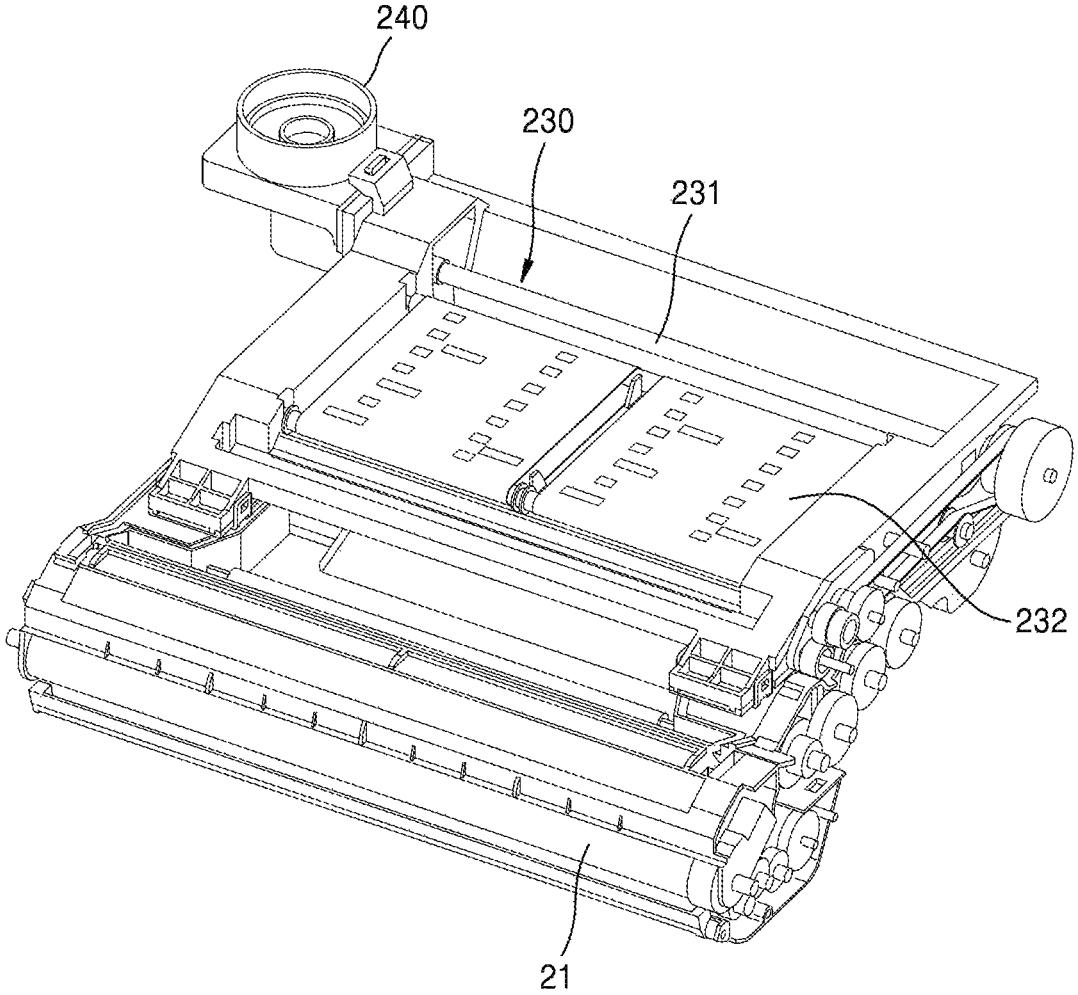
FIG. 6 is a perspective view illustrating an interior of a toner container included in the development cartridge of FIG. 3.
Figure 7:
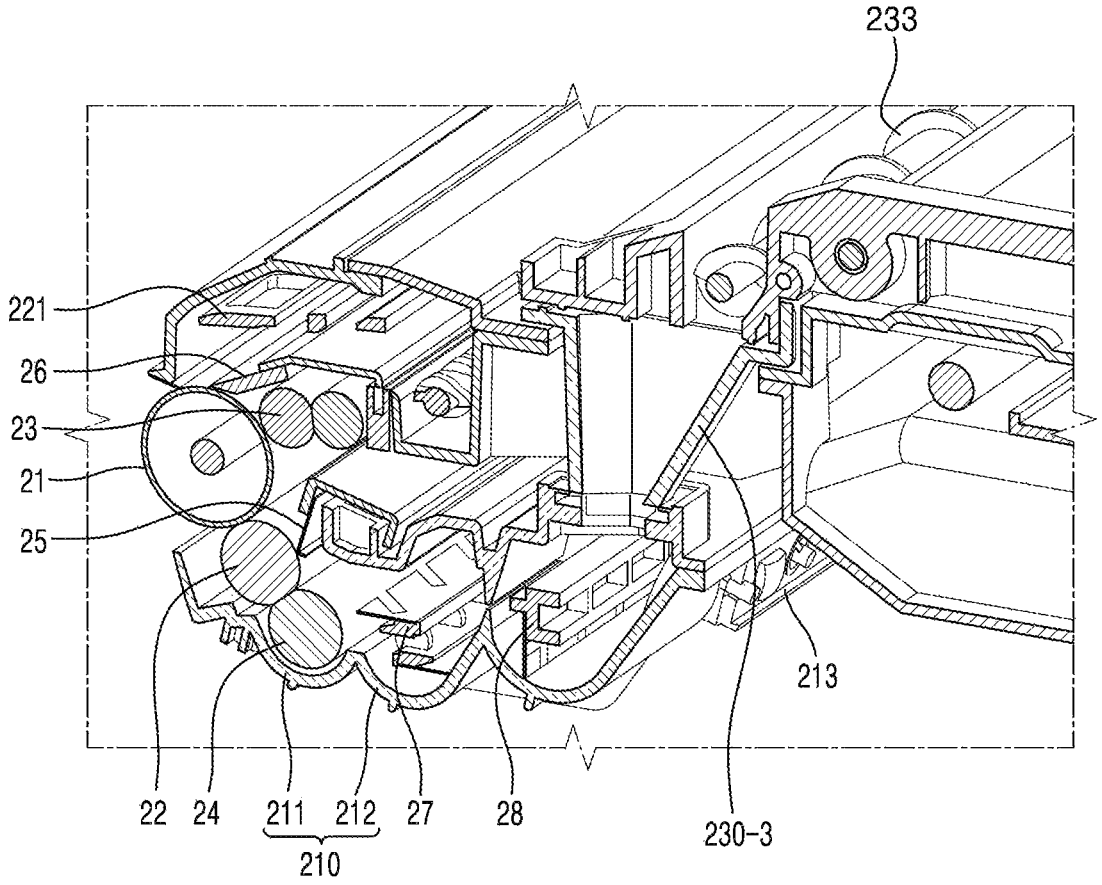
FIG. 7 is a partial cross-section perspective view illustrating a connection between the toner container and a developing portion.

FIG. 3 is a perspective view of a development cartridge used in the printer of FIG. 1, according to an example. FIG. 4 is a cross-section taken along a line X1-X1' of FIG. 3. FIG. 5 is a perspective view illustrating an interior of a waste toner container 220. FIG. 6 is a partial perspective view illustrating an interior of a toner container 230. FIG. 7 is a partial cross-section perspective view illustrating a connection between the toner container 230 and a developing portion 210. An example of the development cartridge 2 will now be described with reference to FIGS. 3 through 7.

Referring to FIGS. 3 and 4, the development cartridge 2 of the present example includes the developing portion 210 in which the photoconductive drum 21 and the developing roller 22 are provided, the waste toner container 220 in which waste toner removed from the photoconductive drum 21 is received, and the toner container 230 connected to the developing portion 210 and allowing toner to be received therein. In order to refill the toner container 230 with toner, the development cartridge 2 includes a toner refilling portion 240 connected to the toner container 230. The toner refilling portion 240 provides an interface between a toner refill kit 9 (see FIG. 9), which will be described later, and the development cartridge 2. The development cartridge 2 is an integrated development cartridge including the developing portion 210, the waste toner container 220, the toner container 230, and the toner refilling portion 240.

The developing portion 210, the waste toner container 220, and the toner container 230 are stacked vertically. A light path 250, along which exposure light L for exposing the photoconductive drum 21 passes, is formed between the developing portion 210 and the waste toner container 220. A concave portion 260 for accommodating the optical scanner 4 therein may be formed in the development cartridge 2. As shown in FIG. 2, when the development cartridge 2 is mounted on the main body 1, the optical scanner 4 is positioned within the concave portion 260.

A housing that forms an outer appearance of the development cartridge 2 may include a lower frame 310, an intermediate frame 320, and an upper frame 330. The developing portion 210, the waste toner container 220, and the toner container 230 may be formed by the lower frame 310, the intermediate frame 320, and the upper frame 330. The lower frame 310 and the intermediate frame 320 are spaced apart vertically from each other such that the light path 250, along which exposure light L for exposing the photoconductive drum 21 passes, is formed therebetween.

The photoconductive drum 21 and the developing roller 22 are provided in the developing portion 210. A portion of an outer circumferential surface of the photoconductive drum 21 is exposed to the outside of the housing. The transfer roller 5 contacts the exposed portion of the photoconductive drum 21 to form a transfer nip. The developing portion 210 may include a developing room 211 in which the photoconductive drum 21 and the developing roller 22 are provided, and a main hopper 212 positioned between the developing room 211 and the toner container 230 in correspondence with a toner supply path. Conveying members 27 and 28 for conveying toner to the developing room 211 may be provided within the main hopper 212. The conveying members 27 and 28 may agitate the toner and may charge the toner to a predetermined electric potential. Although the two conveying members 27 and 28 are illustrated in FIG. 4, an appropriate number of conveying members may be provided at appropriate positions within the main hopper 212 in order to effectively supply toner into the developing room 211 in consideration of a volume or a shape of the main hopper 212. For example, as shown in FIG. 7, the conveying members 27 and 28 may be paddles including one or a plurality of flexible film-shaped stirring wings provided on a rotating shaft.

The waste toner container 220 is located over the developing portion 210. As described above, the waste toner container 220 is spaced apart from the developing portion 210 such that the light path 250 is formed between the waste toner container 220 and the developing portion 210. Waste toner removed from the photoconductive drum 21 by the cleaning member 26 is received in the waste toner container 220. The waste toner container 220 extends backwards from an end portion of the development cartridge 2 close to the photoconductive drum 21, namely, from an end portion in which the cleaning member 26 is provided, to be longer than a length of the developing portion 210. The concave portion 260 for accommodating the optical scanner 4 therein may be defined behind the developing portion 210 by the developing portion 210 having a smaller length than the waste toner container 220 and the waste toner container 220 located over the developing portion 210.

For example, the waste toner container 220 may include first, second, and third portions 220-1, 220-2, and 220-3 located sequentially from a vicinity of the photoconductive drum 21. The first portion 220-1 is located around the photoconductive drum 21 to primarily receive waste toner. The third portion 220-3 corresponds to the concave portion 260, and is located above the first portion 220-1 in a stepped manner. The second portion 220-2 connects the first portion 220-1 to the third portion 220-3. Accordingly, the second portion 220-2 is upwardly inclined from the first portion 220-1 toward the third portion 220-3. The waste toner container 220 may further include, behind the concave portion 260, a fourth portion 220-4 downwardly extending from the third portion 220-3. Accordingly, a large room may be ensured to accommodate waste toner.

Waste toner removed from a surface of the photoconductive drum 21 is accumulated around the photoconductive drum 21 and is gradually pushed into a rear portion of the waste toner container 220. When a large amount of waste toner is accumulated around the photoconductive drum 21, a waste toner pressure may increase, and thus the waste toner may leak out through a gap between the photoconductive drum 21 and the housing of the development cartridge 2, for example, the intermediate frame 320. Moreover an internal temperature of the printer after an image printing operation is completed may gradually decrease due to remaining heat of the fuser 6, and, during this time, the waste toner accumulated around the photoconductive drum 21 may agglomerate due to the remaining heat of the fuser 6 located close to the accumulated waste toner and may become a lump. Because the waste toner in a lump state is not smoothly pushed into the rear portion of the waste toner container 220, a waste toner pressure around the photoconductive drum 21 may be increased. A waste toner transporting member for conveying waste toner away from the photoconductive drum 21 may be provided in the waste toner container 220.

According to the present example, the waste toner container 220 may include first, second, and third waste toner transporting members 221, 222, and 223 sequentially arranged from the photoconductive drum 21 to the rear portion of the waste toner container 220. The first, second, and third waste toner transporting members 221, 222, and 223 may have any of various structures capable of conveying waste toner from the photoconductive drum 21 to the inside of the waste toner container 220.

Referring to FIG. 4, the first waste toner transporting member 221 conveys waste toner removed from the photoconductive drum 21 and received in the first portion 220-1 to the second portion 220-2. For example, the first waste toner transporting member 221 may have a plate shape in which one end is connected to an eccentric rotation plate 224 and the other end extends toward the photoconductive drum 21. The first waste toner transporting member 221 may be provided with a plurality of through slots 221-1. When the eccentric rotation plate 224 rotates, the first waste toner transporting member 221 reciprocates back and forth within the first portion 220-1, and at the same time, the other end of the first waste toner transporting member 221 close to the photoconductive drum 21 is elevated up and down. Due to a combination between the reciprocation and the elevating of the first waste toner transporting member 221, the waste toner around the photoconductive drum 21 may be conveyed into the second portion 220-2.

Referring to FIGS. 4 and 5, the second waste toner transporting member 222 is provided in the second portion 220-2 to convey waste toner into the third portion 220-3. For example, the second waste toner transporting member 222 may be in the shape of a belt that extends at an incline from the second portion 220-2 to the third portion 220-3 and circulates. As shown in FIG. 5, a plurality of through holes may be formed in the belt to secure a waste toner supply capability. Although not illustrated, a plurality of conveying pins may be provided on an outer circumferential surface of the belt.

The third waste toner transporting member 223 disperses waste toner to an inner side of the third portion 220-3. The third waste toner transporting member 223 may extend to the fourth portion 220-4 to convey waste toner into the fourth portion 220-4. For example, as shown in FIGS. 4 and 5, the third waste toner transporting member 223 may have a plate shape in which one end is connected to an eccentric rotation plate 225 and the other end extends in a direction away from the photoconductive drum 21, namely, to the inner side of the third portion 220-3. The other end of the third waste toner transporting member 223 may extend to the fourth portion 220-4. The third waste toner transporting member 223 may be provided with a plurality of through slots 223-1. When the eccentric rotation plate 225 rotates, the third waste toner transporting member 223 reciprocates back and forth within the third portion 220-3 and the fourth portion 220-4, and, during this time, conveys waste toner to the fourth portion 220-4. At the same time, the other end of the third waste toner transporting member 223 elevates up and down within the fourth portion 220-4. Due to the elevation of the other end, the third waste toner transporting member 223 may agitate the waste toner within the fourth portion 220-4 and evenly disperse the waste toner into the fourth portion 220-4.

Referring to FIGS. 3 and 4, the toner container 230 includes a hopper portion 230-1 that is connected to the toner refilling portion 240 and receives toner. The hopper portion 230-1 may be positioned at a location spaced apart from and behind a toner supply portion 230-3. For example, the hopper portion 230-1 may be located over the fourth portion 220-4 of the waste toner container 220. An upper wall **220-4*a* of the fourth portion 220-4 may be partially concavely engraved, and the hopper portion 230-1 may be downwardly convex with a shape complementary to the upper wall 220-4*a*. Accordingly, the hopper portion 230-1** may have a large volume.

The toner container 230 may further include a connection passage portion 230-2 extending forwards from the hopper portion 230-1, namely, towards the developing portion 210. The connection passage portion 230-2 extends over the developing portion 210. As indicated by a dotted line of FIG. 4, the connection passage portion 230-2 is connected to the developing portion 210 by the toner supply portion 230-3. As shown in FIG. 7, the toner supply portion 230-3 may connect the toner container 230 to the main hopper 212. According to the development cartridge 2 of the present example, the waste toner container 220 is interposed between the developing portion 210 and the toner container 230. The light path 250 is interposed between the developing portion 210 and the waste toner container 220. As shown in FIGS. 5 and 7, the toner supply portion 230-3 may vertically pass through the waste toner container 220 and may be connected to the developing portion 210, for example, the main hopper 212. FIG. 5 illustrates a portion of the toner supply portion 230-3. The toner supply portion 230-3 is located in order not to interfere with the exposure light L scanned in a main scanning direction M by the optical scanner 4. In other words, the toner supply portion 230-3 is located outside an effective width of the exposure light L. The toner supply portion 230-3 is located inside a length of the photoconductive drum 21. Because the toner supply portion 230-3 is located inside a length of the photoconductive drum 21, a compact development cartridge 2 may be realized.

A toner supply member for supplying toner through the toner supply portion 230-3 to the developing portion 210 may be provided in the toner container 230. Shapes and the number of toner supply member are not particularly limited. An appropriate number of toner supply member may be provided at appropriate positions in the toner container 230 in order to effectively supply the toner to the developing portion 210 in consideration of a volume or a shape of the toner container 230.

For example, as shown in FIG. 4, the toner container 230 may include first, second, and third toner supply members 231, 232, and 233.

The first toner supply member 231 is provided in the hopper portion 230-1 and conveys the toner within the hopper portion 230-1 toward the connection passage portion 230-2. For example, the first toner supply member 231 may be a paddle including one or a plurality of flexible film-shaped stirring wings provided on a rotating shaft.

The second toner supply member 232 is provided in the connection passage portion 230-2 to receive toner from the first toner supply member 231 and convey the received toner toward the toner supply portion 230-3. For example, the second toner supply member 232 may be a belt that extends along the connection passage portion 230-2 and circulates. As shown in FIG. 6, a plurality of through holes may be formed in the belt to secure a toner supply capability. Although not illustrated, a plurality of conveying pins may be provided on an outer circumferential surface of the belt.

The third toner supply member 233 is located around an end portion of the connection passage portion 230-2 close to the developing portion 210. The third toner supply member 233 is located over the toner supply portion 230-3. Because the toner supply portion 230-3 is located outside the effective width of the exposure light L in the main scanning direction M, the third toner supply member 233 receives toner from the second toner supply member 232, conveys the received toner in the main scanning direction M, and delivers the toner into the toner supply portion 230-3. For example, as shown in FIG. 7, the third toner supply member 233 may be implemented by an auger including a rotation shaft extending in the main scanning direction M and a spiral wing formed on an outer circumferential surface of the rotation shaft. When two toner supply portions 230-3 spaced apart from each other in the main scanning direction M are provided as shown in FIG. 5, the spiral wing of the third toner supply member 233 may be divided into two spiral wings having different spiral directions relative to a center of the main scanning direction M so that toner may be conveyed towards both the two toner supply portions 230-3 in the main scanning direction M.

Due to this configuration, the toner contained in the hopper portion 230-1 may be supplied into the developing portion 210, for example, the main hopper 212, via the connection passage portion 230-2 and the toner supply portion 230-3.

Figure 8:
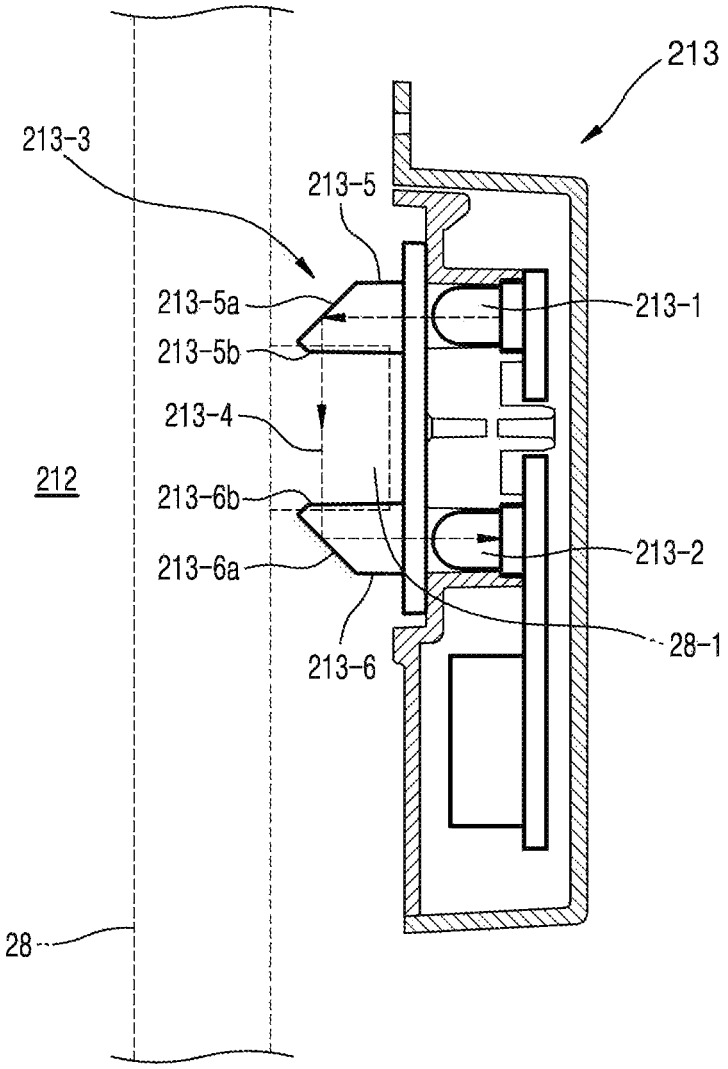
FIG. 8 is a cross-sectional view illustrating a configuration of a remaining amount detection sensor according to an example.

The main hopper 212 may be provided with a remaining amount detection sensor 213 for detecting the remaining amount of toner. FIG. 8 is a cross-sectional view illustrating a configuration of the remaining amount detection sensor 213 according to an example. The remaining amount detection sensor 213 may be implemented in various shapes. The remaining amount detection sensor 213 of the present example is an optical sensor.

Referring to FIG. 8, the remaining amount detection sensor 213 may include a light emitter 213-1 and a light receiver 213-2. Light 213-4 emitted by the light emitter 213-1 passes through the main hopper 212 and is incident upon the light receiver 213-2. The light emitter 213-1 and the light receiver 213-2 are located outside the main hopper 212 in order to avoid contamination due to toner. The remaining amount detection sensor 213 further includes a light guiding member 213-3 for guiding the light 213-4 emitted by the light emitter 213-1 to the light receiver 213-2 via the main hopper 212. The light guiding member 213-3 may be formed of a transparent material capable of transmitting the light 213-4. The light guiding member 213-3 may include first and second light guiding portions 213-5 and 213-6. The first and second light guiding portions 213-5 and 213-6 are located apart from each other within the main hopper 212. The first light guiding portions 213-5 guides the light 213-4 emitted by the light emitter 213-1 to the main hopper 212. The second light guiding portion 213-6 guides light 213-4 transmitted through the main hopper 212 to the light receiver 213-2. The first and second light guiding portions 213-5 and 213-6 include first and second light path changing portions **213-5*a* and 213-6*a*, respectively. The first light path changing portion 213-5*a* reflects the light 213-4 emitted by the light emitter 213-1 toward the second light path changing portion 213-6*a*, and the second light path changing portion 213-6*a* reflects the light 213-4 toward the light receiver 213-2. Each of the first and second light path changing portions 213-5*a* and 213-6*a* may be implemented by, for example, an inclined surface having a certain inclination angle. The inclination angle of the inclined surface may be, for example, an angle that satisfies total reflection conditions. A reference location of the light 213-4 that passes through the main hopper 212 may be set in consideration of a reference toner level within the main hopper 212**.

Due to the aforementioned configuration, the amount of light detected by the light receiver 213-2 varies according to the toner level within the main hopper 212, and accordingly the toner level (remaining amount of toner) within the main hopper 212 may be detected based on the amount of light detected by the light receiver 213-2. When the toner level within the main hopper 212 is lower than a certain reference level, the first, second, and third toner supply members 231, 232, and 233 may be driven to supply toner from the toner container 230 to the main hopper 212. Accordingly, the toner level within the main hopper 212 may be maintained to be an appropriate level. Toner oversupply within the main hopper 212 and an increase in a toner pressure due to the toner oversupply may be prevented, and thus stress applied to toner may be reduced. Moreover, because the light emitter 213-1 and the light receiver 213-2 are located outside the main hopper 212 and thus do not directly contact the toner within the main hopper 212, the light emitter 213-1 and the light receiver 213-2 may not be contaminated by toner, and reliability of detection of the remaining amount of toner may improve.

A light-exit surface 213-5*b* and a light-incidence surface 213-6*b* of the first and second light guiding portions 213-5 and 213-6 that face each other contact the toner within the main hopper 212. When the light-exit surface 213-5*b* and the light-incidence surface 213-6*b* are contaminated by toner, it may be difficult to reliably detect a toner level. Referring to FIG. 8, the main hopper 212 may be provided with a wiper 28-1 that wipes the light-exit surface 213-5*b* and the light-incidence surface 213-6*b*. The wiper 28-1 is indicated by a dotted line of FIG. 8. The wiper 28-1 periodically wipes the light-exit surface 213-5*b* and the light-incidence surface 213-6*b* to remove toner from the light-exit surface 213-5*b* and the light-incidence surface 213-6*b*. As an example, the wiper 28-1 may be provided on a rotating shaft of the conveying member 28 and may wipe the light-exit surface 213-5*b* and the light-incidence surface 213-6*b* while rotating together with the conveying member 28. Due to this configuration, the reliability of detection of the remaining amount of toner leaks may be improved.

According to the development cartridge 2 including the toner container 230 in addition to the main hopper 212, an initial toner containing amount may be increased, and thus the lifetime of the development cartridge 2 may be extended and a large-capacity development cartridge 2 may be obtained.

Because the toner within the developing portion 210 is continuously agitated by the conveying members 27 and 28, the toner may have stress. When stress is accumulated in the toner, the characteristics of the toner may degrade, leading to a degradation of the quality of image. According to the present example, toner may be dispersed and received in the developing portion 210 and the toner container 230, and, as toner is consumed by the developing portion 210, toner may be refilled from the toner container 230 into the developing portion 210. Accordingly, the time during which toner remains in the developing portion 210 may be reduced, stress applied to the toner may be reduced, and the quality of image may be maintained during the lifetime of the development cartridge 2.

As described above, the development cartridge 2 of the present example includes the toner refilling portion 240 for refilling toner. According to the printer of the present example, the development cartridge 2 may be refilled with toner in a state where the development cartridge 2 is mounted on the main body 1, without being removed from the main body 1.

Referring to FIG. 1, a communicating portion 8 is formed in the main body 1 so as to access the toner refilling portion 240 from the outside of the main body 1 in a state where the development cartridge 2 is mounted on the main body 1. For example, when the toner refill kit (toner cartridge) 9 in which toner is received is inserted into the communicating portion 8, the toner refill kit 9 may be connected to the toner refilling portion 240. In this state, the toner received in the toner refill kit 9 may be refilled in the toner container 230 through the toner refilling portion 240. The toner refill kit 9 is removed from the communicating portion 8 after the toner is refilled.

In this configuration, since toner may be refilled in the toner container 230 through the toner refilling portion 240, a replacement time of the development cartridge 2 may be extended until a lifetime of the photoconductive drum 21 ends, thereby reducing printing costs per sheet. Since toner may be refilled in a state where the development cartridge 2 is mounted on the main body 1, user convenience may be improved.

The communicating portion 8 may be provided at a position close to a front portion 12 (see FIG. 1) of the main body 1. Since the front portion 12 faces a user, the user may easily access the communicating portion 8. Accordingly, a toner refilling operation through the communicating portion 8 may be easily performed.

The communicating portion 8 may be formed in a top surface 11 of the main body 1. The toner refilling portion 240 is located under the communicating portion 8. The communicating portion 8 and the toner refilling portion 240 may be vertically aligned with each other. The toner refill kit 9 may access the toner refilling portion 240 from the top of the main body 1 through the communicating portion 8.

Figure 9:
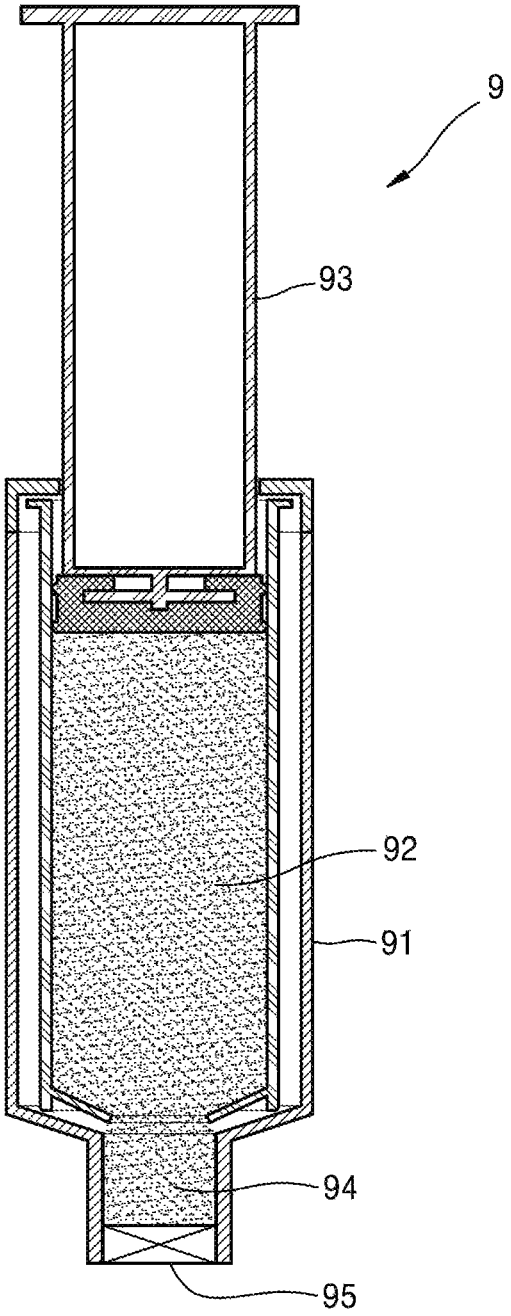
FIG. 9 is a cross-sectional view of a toner refill kit according to an example.

FIG. 9 is a cross-sectional view of the toner refill kit 9 according to an example. Referring to FIG. 9, the toner refill kit 9 may be a syringe-type toner cartridge including a body 91 that is hollow and has an inner space 92 in which toner is received and a plunger 93 that is coupled to the inner space 92 to be movable in a longitudinal direction and pushes the toner to the outside of the body 91. The body 91 may have, for example, a cylindrical shape. A toner outlet 94 through which the toner is discharged and a discharge shutter 95 configured to open/close the toner outlet 94 may be provided on an end portion of the body 91. The plunger 93 is inserted into the inner space 92 from an end portion of the body 91 opposite to the toner outlet 94. For example, the discharge shutter 95 may open the toner outlet 94 when the toner refill kit 9 is connected to the toner refilling portion 240 of the development cartridge 2. Although not shown in FIG. 9, an operating lever for manually operating the discharge shutter 95 may be provided on the toner refill kit 9.

Figure 10:
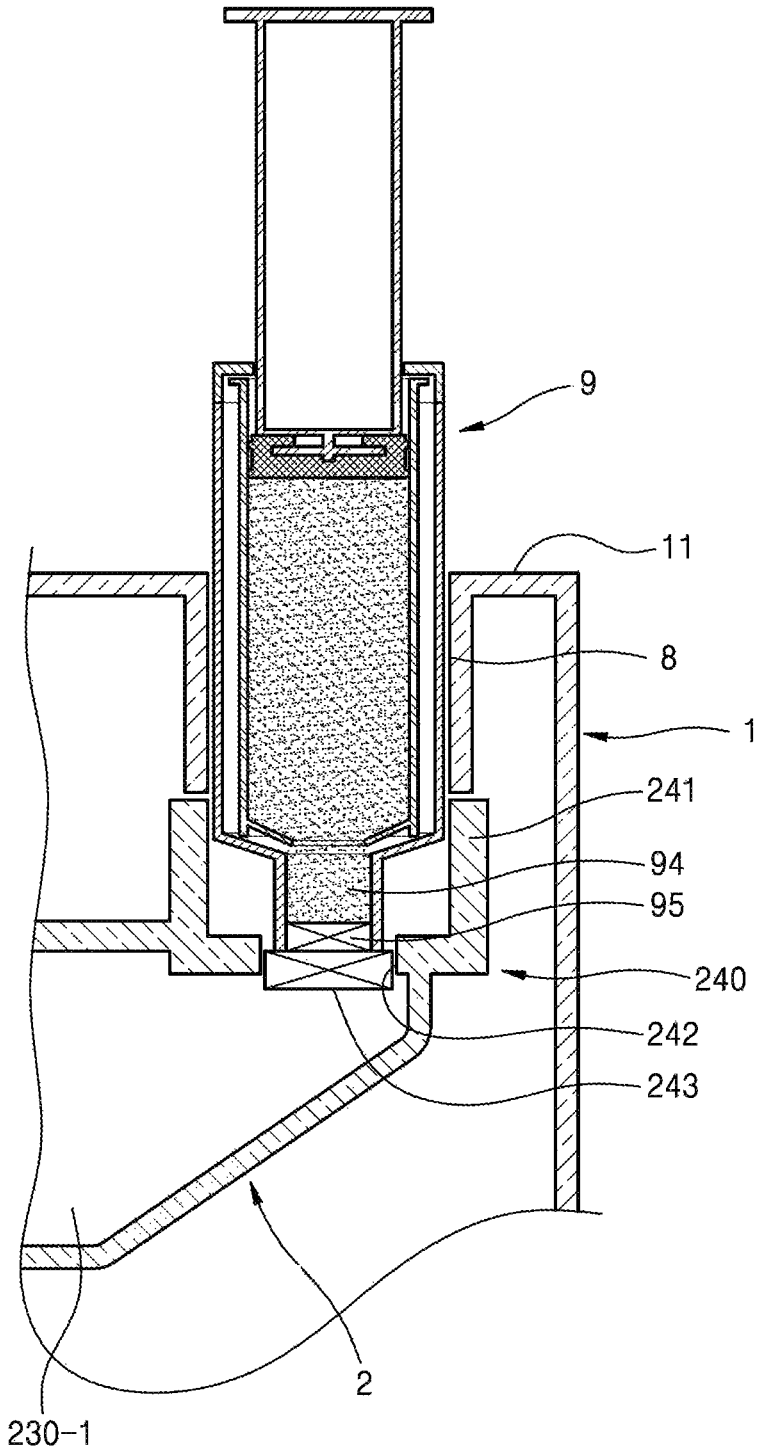
FIG. 10 is a partial cross-sectional view illustrating combination of the toner refill kit with a toner refilling portion through a communicating portion.

FIG. 10 is a partial cross-sectional view illustrating combination of the toner refill kit 9 with the toner refilling portion 240 through the communicating portion 8. Referring to FIG. 10, the toner refill kit 9 is inserted into the communicating portion 8 from the top of the main body 1 in a vertical direction (gravity direction). Because the communicating portion 8 is vertically aligned with the toner refilling portion 240, the toner refill kit 9 may be easily connected to the toner refilling portion 240 through the communicating portion 8.

For example, the toner refilling portion 240 may be provided with a receptor 241 that partially receives the toner refill kit 9, a toner inlet 242 through which toner is introduced, and an inflow shutter 243 opening or closing the toner inlet 242. The shape of the receptor 241 is not particularly limited, and may be a shape capable of receiving a portion of a body 91 of the toner refill kit 9 and aligning the toner outlet 94 with the toner inlet 242. For example, the receptor 241 may have a shape capable of fixing the toner refill kit 9. Due to connection of the toner refill kit 9 to the toner refilling portion 240, the discharge shutter 95 and the inflow shutter 243 may be switched to open the toner outlet 94 and the toner inlet 242, respectively. Although not shown in FIG. 10, an operating lever for manually operating the discharge shutter 95 may be provided on the toner refill kit 9, and, by operating the operating lever, the discharge shutter 95 and the inflow shutter 243 may be simultaneously switched to open the toner outlet 94 and the toner inlet 242.

In this state, when the plunger 93 is pressed, the toner contained in the inner space 92 may pass through the toner outlet 94 and the toner inlet 242 and may be refilled in the toner container 230. When the refilling is completed, the toner refill kit 9 is removed from the main body 1.

A general toner refill kit is mounted on the main body 1 and supplies toner to the development cartridge 2 while the printer is being used. To this end, the general toner refill kit is provided with a conveying member that is power-connected to the main body 1 and conveys toner contained in the general toner refill kit to the development cartridge 2. Because the general toner refill kit needs to be always mounted on the main body 1, the size of the main body 1 is increased by the size of a space occupied by the general toner refill kit.

Because the toner refill kit 9 of the present example is removed from the main body 1 after being partially connected to the main body 1 and manually supplying toner to the development cartridge 2, a conveying member that operates with power received from the main body 1 is not necessary. Thus, the toner refill kit 9 may have a lower price compare with the general toner refill kit. Moreover, because the main body 1 needs a space capable of partially receiving the toner refill kit 9, a compact main body 1 may be realized.

When the toner refill kit 9 is horizontally mounted on the main body 1 and toner is injected into the development cartridge 2 by pressing the plunger 93, the main body 1 may be pushed horizontally. However, according to the present example, because the toner refill kit 9 is vertically mounted on the main body 1 and is connected to the toner refilling portion 240 and is partially supported by the communicating portion 8, the toner refill kit 9 may maintain a stable connection (interface) with the toner refilling portion 240 when injecting toner into the development cartridge 2 by pressing the plunger 93. Moreover, because the plunger 93 is pressed in a gravity direction, the main body 1 may be prevented from being pushed during toner injection.

While the disclosure has been particularly shown and described with reference to examples thereof, it will be understood by those of ordinary skill in the art that various changes in form and details may be made therein without departing from the spirit and scope as defined by the following claims.

What is claimed is:

1. A printer comprising:

a main body;

a development cartridge to attach to the main body at a position and to detach from the main body, the development cartridge comprising:

a developing portion to receive toner in which a photoconductive drum and a developing roller are provided, a waste toner container to contain waste toner removed from the photoconductive drum, a toner container connected to the developing portion and to contain toner to be supplied to the developing portion, and a toner refilling portion connected to the toner container to refill toner through the toner refilling portion into the toner container; and a communicating portion provided in the main body to be aligned with the toner refilling portion of the development cartridge when the development cartridge is attached to the main body at the position, to be in communication with the toner refilling portion to provide an access to the toner refilling portion from outside of the main body, wherein the developing portion, the waste toner container, and the toner container are stacked.

2. The printer of claim 1, wherein the communicating portion is located on a surface of the main body.

3. The printer of claim 1, wherein a light path along which exposure light to expose the photoconductive drum passes is formed between the developing portion and the waste toner container.

4. The printer of claim 3, wherein the development cartridge comprises a toner supply portion to connect the toner container to the developing portion, and the toner supply portion is located outside an effective width of the exposure light when the exposure light is in a main scanning direction and having the effective width.

5. The printer of claim 4, wherein the toner supply portion is located to correspond within a length of the photoconductive drum.

6. The printer of claim 4, wherein the toner supply portion passes through the waste toner container.

7. The printer of claim 4, wherein the toner container comprises:

a hopper portion connected to the toner refilling portion; and a connection passage portion extending from the hopper portion and connected to the toner supply portion.

8. The printer of claim 4, wherein the toner container comprises a toner supply member to supply toner to the developing portion through the toner supply portion.

9. The printer of claim 1, wherein an optical scanner to scan exposure light to the photoconductive drum is provided in the main body, and a concave portion to receive the optical scanner is formed in the development cartridge.

10. The printer of claim 9, wherein the concave portion is formed in the waste toner container.

11. The printer of claim 1, wherein the developing portion comprises:

a developing room in which the developing roller and the photoconductive drum are provided;

a main hopper located between the toner container and the developing room;

a conveying member to convey toner from the main hopper to the developing room; and a detection sensor to detect an amount of toner remained within the main hopper.

12. A development cartridge to attach to a printer, the development cartridge comprising:

a developing portion to receive toner in which a photoconductive drum and a developing roller to supply toner to an electrostatic latent image formed on the photoconductive drum are provided, a toner container to contain the toner to be supplied to the developing roller, a waste toner container to contain waste toner removed from the photoconductive drum, and a toner refilling portion connected to the toner container to refill toner through the toner refilling portion into the toner container, wherein the developing portion, the waste toner container, and the toner container are stacked.

13. A toner refill kit to contain toner and to be connected to the toner refilling portion comprised in the development cartridge of claim 12, the toner refill kit comprising:

a body including an internal space to contain toner, and a toner outlet through which toner contained in the internal space is dischargeable;

a plunger inserted into the internal space to be movable in a longitudinal direction of the body; and a discharge shutter to open and close the toner outlet.

* * * * *